United States Patent [19]

Kriss

[11] Patent Number: 5,074,084

[45] Date of Patent: Dec. 24, 1991

[54] DECK CONSTRUCTION

[76] Inventor: Fred C. Kriss, 236 English La., Mays Landing, N.J. 08009

[21] Appl. No.: 502,999

[22] Filed: Apr. 2, 1990

[51] Int. Cl.[5] ..... E04B 1/00

[52] U.S. Cl. ..... 52/73; 52/263; 52/236.2

[58] Field of Search ..... 52/660, 581, 575, 631, 52/73, 631, 89, 245, 94, 90, 95, 96, 236.2, 245, 247, 263, 299

[56] References Cited

U.S. PATENT DOCUMENTS

| | | | |
|---|---|---|---|
| 2,376,906 | 5/1945 | Davidson | 52/86 |
| 2,536,389 | 1/1951 | Orzel | 52/246 |
| 3,783,562 | 1/1974 | Kriss | 52/94 |

*Primary Examiner*—John E. Murtagh

*Attorney, Agent, or Firm*—Zachary T. Wohensmith, III

[57] ABSTRACT

This invention is directed to deck construction for circular freeform wood platform decks, which are of the cantilever type and include perimeter joists which have wood plates fastened thereon cut to the desired radius, with vertical fascia wood strips fastened thereto to form the outside edge of the deck.

2 Claims, 3 Drawing Sheets

DECK CONSTRUCTION

BACKGROUND OF THE INVENTION

1. Field of the Invention

This invention relates to wood deck construction of the cantilevered, circular, or freeform type.

2. Description of the Prior Art

The use of cantilever type wood deck platform construction has existed for many years. Typically this construction utilizes a substructure including inground footings that support the main beams upon which a joist structure is framed. Joists are placed on top of the main beams at intervals, which are usually sixteen inches on center. The joists cantilever past exterior beams commonly a distance of twenty-four inches, which results in a less visible deck substructure. The prior art systems are primarily utilized for large or freestanding deck platforms that by design can not be attached to an adjacent structure by ledger beams do not or can not contain a perimeter flush beam header, or perimeter post support system; or require projection over and beyond a fixed object such as a wall or bulkhead.

The use of decks to provide outside areas for asthetic considerations, or for entertainment has greatly expanded in recent years. The desire to provide a deck construction that can accomplish the desired asthetic effect while still maintaining structural integrity and keeping the cost low has proven difficult.

In cantilevered framing, the recommended framing configuration includes a perimeter structural member known as a "rim", "band", or "ribbon" joist. When perpendicular to joists the member serves, as a "header" or "trimmer" that ties the individual joists together, and does not significantly contribute to deck surface support. When the member is parallel to internal joists it acts as the exterior structural joist member, which is responsible to carry the deck surface weight on the exterior span. The rim joist may be positioned at an angle to the joists without compromise of strength (when properly supported by beam sub-structure) and with little added carpentry skill. A fascia may be added to the perimeter joist to provide a decorative facade, or a separate structure attached to and utilizing the perimeter joist may function as skirting to elimiate sub-structure visibility.

In flush beam deck platform framing, the perimeter member or "header" is the structural beam from which all joists are supported or "hung". The joists are set between beams and normally rest on an attached "ledger" with the flush beam supported by perimeter posts.

While both systems serve well for their intended function in the construction of wood platform decks of rectangular or angled perimeter shape, a rigid wood exterior structural member on the flush beam normally precludes its use for circular or freeform shapes that utilize flexible or bent wood members. At present three variations of the construction system utilizing cantilevered joists are available, when a circular or freeform shape is desired.

The first method is based on bending the perimeter structural member to the desired shape, and then securing it to the joists that have been pre-cut to perimeter shape. As the perimeter wood member size increases or the radius of the bend decreases, "kerfing" of the member is required. "Kerfing " which involves saw blade cutting of a wood member at prescribed intervals to a partial depth to remove stock and enable wood to become more flexible, of any wood member reduces its structural strength, integrity, and fastening ability. It is very difficult to achieve a true arc or radius, when small dimensions or reverse curves are required, by bending wood intended for strutural members, even when kerfed. Fastening and in place retention of the actual member as well as the fastening of deck surfaces and fascia to this member present equally difficult challenges. Costs in labor and material are unpredictable at best.

The second method utilizes lamination, etiher horizontal or vertical, of layers of wood members to achieve the perimeter shape of the deck. Both dimensional requirements and fastening problems exist in this method and the "on site" or "in shop" milling, gluing-up and clamping of perimeter members results in time inefficiency, and extremely high costs of material and labor-supervision. This method is used infrequently for sub-structures.

The third and most prevalent method of creating circular or freeform deck shapes as viewed from the deck surface is achieved with the sub-structure constructed in a segmented circle. Short lengths of perimeter joists are set on angles following the exterior radius or arc of the deck surface. This method does not achieve a sub-structure that is aesthetically mated to the circular or freeform surface, and requires the use of extended, unsupported surface overhang, resulting in deck edge instability, and does not achieve a true circular or freeform deck.

The deck construction of the invention provides structures built to tru arc configuration, that have high structural integrity, and are of relative low cost, simple construction.

SUMMARY OF THE INVENTION

This invention relates to cantilevered wood deck construction for circular or freeform decks without the use of bent lumber for rim joists or fascia boards or laminated construction. The deck construction contemplates the use of flat horizontally oriented dimensional wood plates fastened to joists that are backed by solid vertical bridging, which has been fastened to the joists and to the flat plates. Vertical fascia boards are attached to the plates which permits of circular arcs, and of reverse arcs of both large and small radius. If the flat plates are installed parallel to the exterior joists spacer blocks are added to improve stability.

The principal object of the invention is to provide deck construction for circular and freeform decks that is cantilevered, and is universal in application to the size, configuration, or combination of the desired arc or radius.

A further object of the invention is to provide deck construction in which material and labor are most efficiently utilized, and in which costs can be predictably quantified.

A further object of the invention is to provide deck construction that can be easily constructed and reproduced with consistent results.

A further object of the invention is to provide deck construction wherein considerable reduction of labor and material can achieved.

A further object of the invention is to provide deck construction wherein the use of bent lumber or laminated structural members for rim joists or fascia application have been eliminated.

A further object of the invention is to provide deck construction aesthetically pleasing when viewed from both on the deck surface and sub-structure locations.

A further object of the invention is to provide deck construction that provides a high degree of structural stability and integrity.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Figure 1:
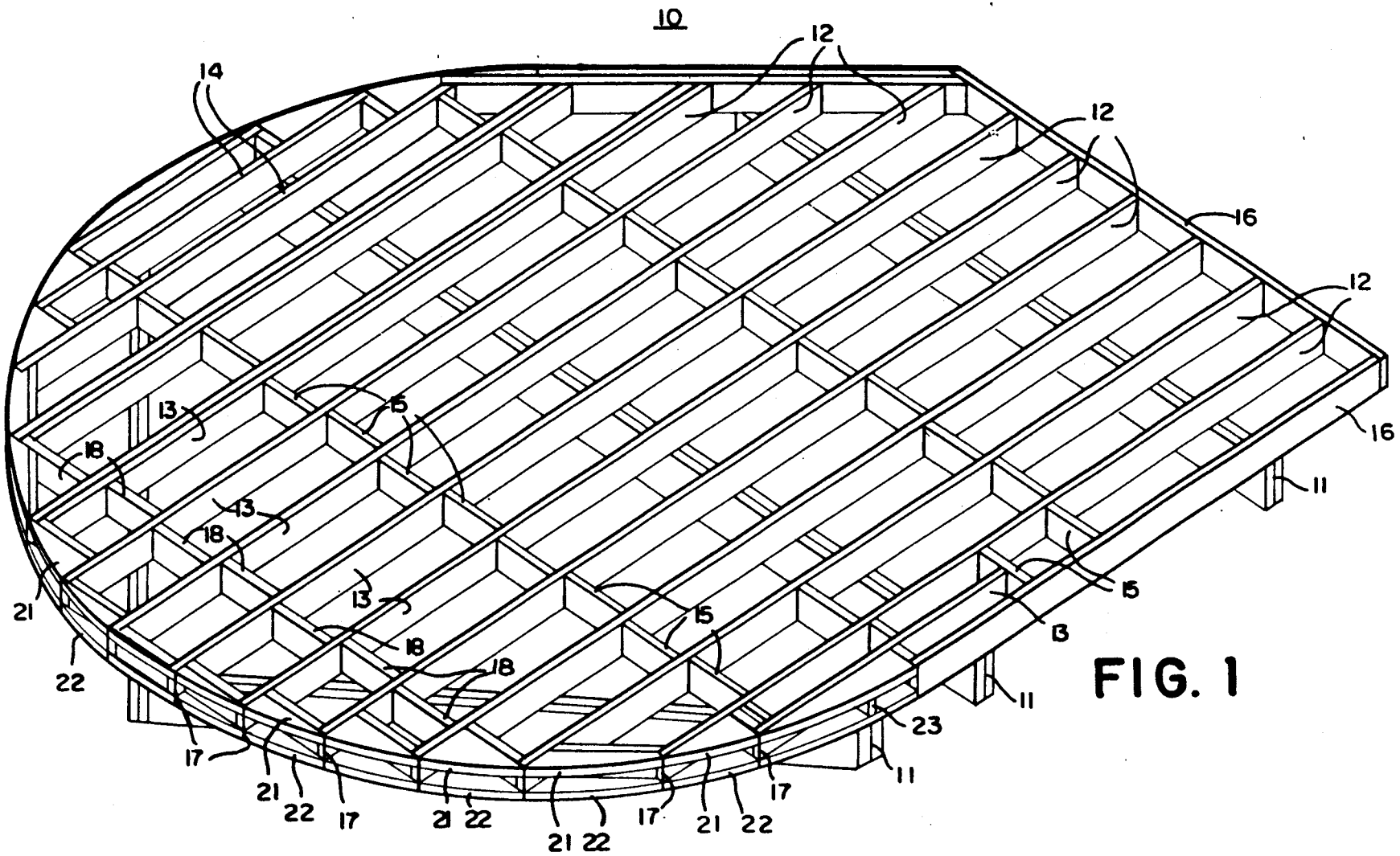
FIG. 1 is a perspective view of a deck joist framing structure, and which includes the structure of the invention.
Figure 2:
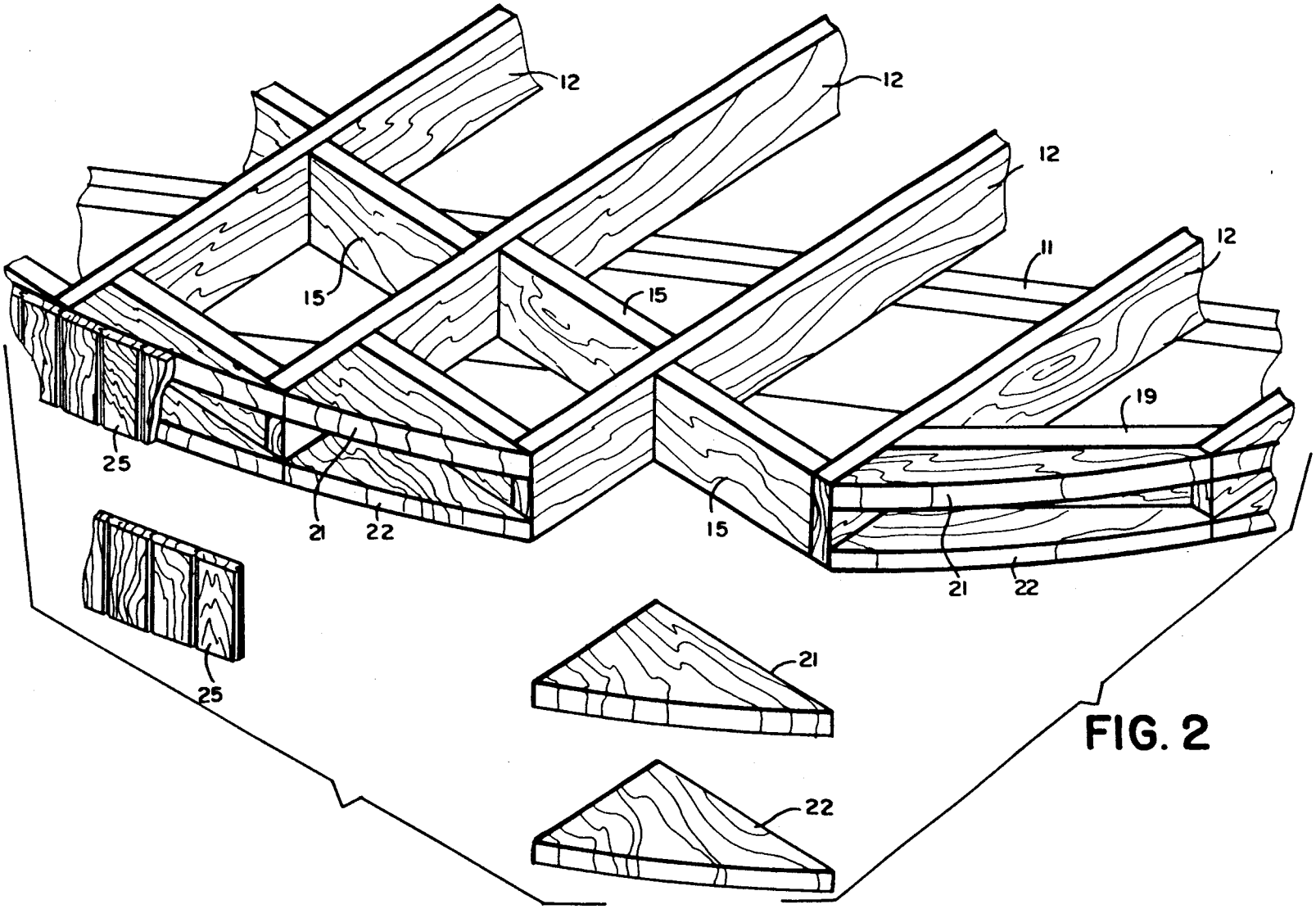
FIG. 2 is an enlarged exploded portion of FIG. 1 showing details of the deck construction of the invention.

Referring now more particularly to the drawings and FIGS. 1 and 2, a prefered embodiment of deck construction is illustrated therein installed in connection with a cantilevered wood deck framing system 10 of well known type.

A series of appropriately spaced concrete column footings (not shown) with beam seat anchors or posts (not shown) support the beam structure 11. A joist framing structure 12 of 2×6 inch wood members spaced sixteen (16") inches o.c. (on center) is constructed atop a sub-structure which includes a plurality of exterior beams 11. Additional joists 13 are installed, or joist 14 spacing may be decreased, as required on the exterior parallel joist span to provide a maximum flat (horizontal) plate dimension of eleven (11") inches. The joists 12, 13, 14 are installed to cantilever past the exterior beams 11 so that the joist ends extend past the required perimeter dimension of the desired radius of the circular area to be constructed as established from a fixed centerpoint. Solid blocking 15 is installed preferably by nailing and perpendicular to, and between each joist 12, 13, 14. Blocking runs are located between each beam span with the line of blocking extending from the exterior most joists. Perimeter joists 16 are installed as required to complete the standard joist framing substructure for a platform deck.

Deck joists 12, 13, 14 in the circular perimeter are marked at the required radius from an established (fixed) center point on the exterior most edge of the circumference and then trimmed square 17. Vertical plate blocking 18, solid blocking adjacent to flat plates, is installed preferably by nailing between joists 12, 13, 14 perpendicular to the joists, and flush with the trimmed end 17 of the joist creating a ninety (90) degree attachment area for flat (horizontal) plates to be described. Vertical plate bridging 19, angled solid blocking adjacent to flat plates is installed preferably by nailing between joists 12, at a 45 degree angle on interior joist spaces exceeding the eleven (11") Inch maximum flat plate dimension.

A top flat plate 21 of 2 inch (nominal) thick wood of appropriate dimension is mechanically fastened by nails or screws (not shown) into the joist 12, 13, 14, and the vertical plate blocking 18 previously installed. Fasteners are installed within the required dimension to avoid interference with the outer perimeter. The perimeter radius is marked after installation of all top flat plates 21, and plates 21 are cut to the marked radius dimension. A bottom flat (horizontal) plate 22 is scribed to the dimension of the top flat plate 21 previously installed, and is cut to identical shape, and then affixed as described above. Exterior flat (horizontal) plates affixed to parallel joists and supported by beams, require a stiffener block 23 to be installed after final cutting.

The fascia boards 25 are applied preferably by nailing to the upper and lower flat plates 21 and 22 to provide a finish edging covering the exterior joist framing.

Figure 3:
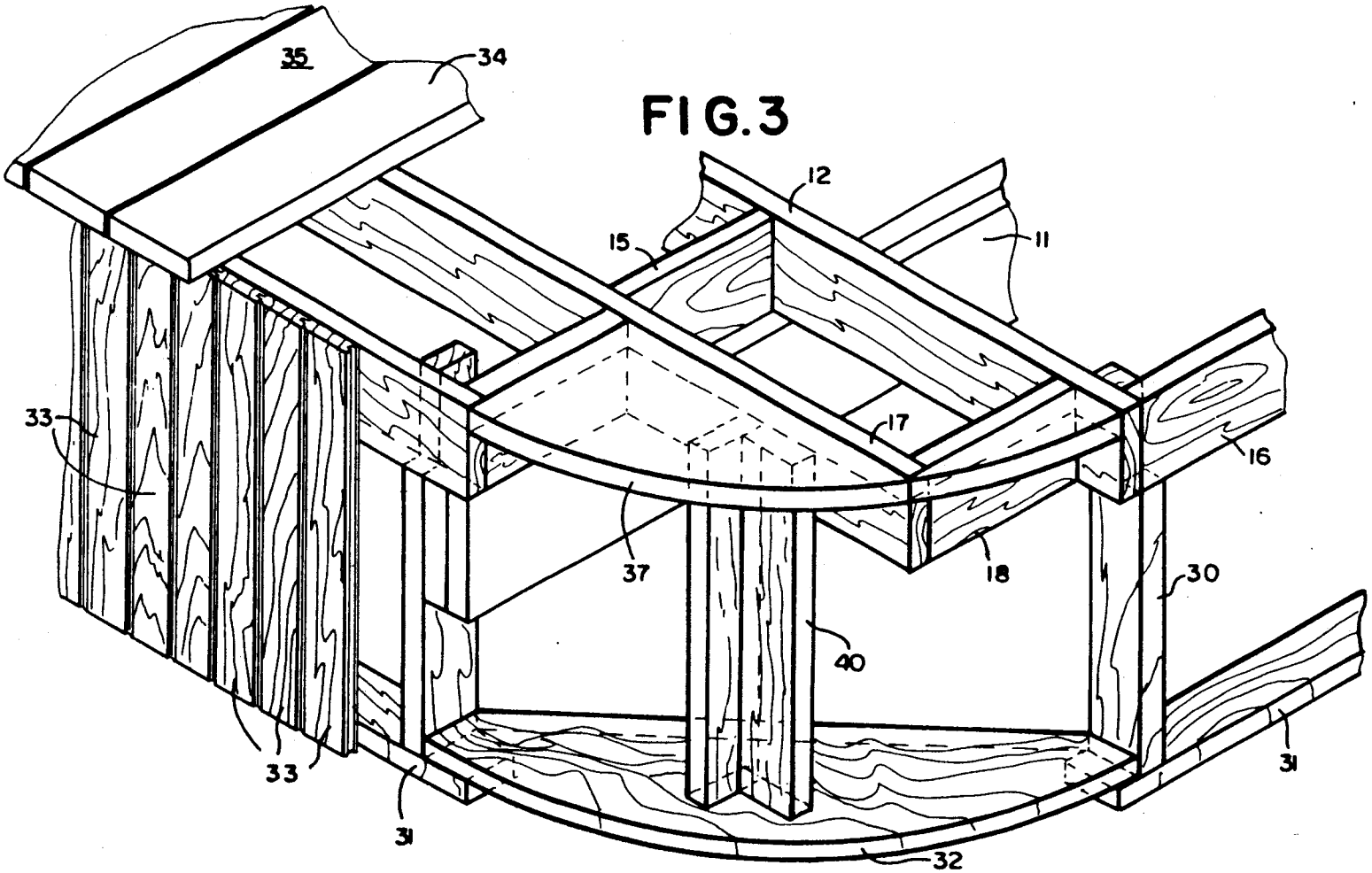
FIG. 3 is an enlarged portion of the deck construction of FIG. 1 illustrating the extended fascia embodiment of the invention.

Referring now more particularly to FIG. 3 another embodiment of the invention is illustrated when it is desired to provide an extended fascia system, which is not supported in the same manner as described above. In this embodiment a stud wall structure 30, consisting of 2×4 inch (nominal) studs placed at regular intervals, usually sixteen inches on center, is affixed to the perimeter deck joists 16, and suspends a bottom skirt wall plate 31 within one or two inches from grade.

At the projecting end of each internal joist 12, 13, 14, that contains an upper flat (horizontal) plate 21, 37, forming the circular perimeter of the joist framing; two-two by four inch (nominal) vertical blocking suspends within one to two inches from grade, a bottom flat (horizontal) plate 32 cut to the required radius prior to installation. The vertical blocking 40 is provided and fastened by nails or screws (not shown) to the upper and lower plates 37, 32 as well as to joist 12, 13, 14; for stability and support. Skirt wall siding 33 is affixed to the stud wall system, and upper and lower plates 37, 32 to prevent viewing of the deck sub-structure. A mid-plate rail (not shown) may also be installed on skirting structures over 36" high, if desired. Boards 34 to provide a deck surface 35 are installed onto joists 12, 13, 14 preferably by nailing (not shown) and cut to overhang 1 " past fascia, to complete the deck.

It will thus be seen that structure has been described with which the objects of the invention are achieved.

I claim:

1. Deck construction for free form or circular configured decks of the cantilevered type which include perimeter joists which extend out over supporting exterior beams, the improvement which comprises at least one pair of upper and lower horizontal plates fastened to at least one of said perimeter joists said plates having their exterior outer surfaces trimmed to conform to the desired free form or circular configuration, and a plurality of vertical fascia boards fastened to said pairs of plates to form the finished outer perimeter of said deck.

2. A deck construction as defined in claim 1 in which stud wall means are fastened to said joists, bottom wall plates are fastened to said wall means, upper wall plates are fastened to said wall means, blocking connect said upper and lower plates, and vertical skirt wall siding is fastened to said upper and lower plates to form the outside deck perimeter.

* * * * *